US005399297A

United States Patent [19]

Panthal et al.

[11] Patent Number: 5,399,297

[45] Date of Patent: Mar. 21, 1995

[54] SOLID DETERGENTS

[75] Inventors: Guenther Panthal, Haan; Karl-Heinz Linde, Langenfeld; Hermann Anzinger, Duesseldorf, all of Germany

[73] Assignee: Henkel Kommanditgesellschaft auf Aktien, Germany

[21] Appl. No.: 66,169

[22] PCT Filed: Nov. 25, 1991

[86] PCT No.: PCT/EP91/02212

§ 371 Date: Jun. 3, 1993

§ 102(e) Date: Jun. 3, 1993

[87] PCT Pub. No.: WO92/09676

PCT Pub. Date: Jun. 11, 1992

[30] Foreign Application Priority Data

Dec. 3, 1990 [DE] Germany ..... 40 38 476.4

[51] Int. Cl.[6] ..... C11D 11/00; C11D 1/14; C11D 17/00

[52] U.S. Cl. ..... 252/550; 252/135; 252/174; 252/174.14; 252/531

[58] Field of Search ..... 252/531, 550, 135, 174.14, 252/174.25, 174

[56] References Cited

U.S. PATENT DOCUMENTS

| | | | |
|---|---|---|---|
| 2,382,163 | 8/1945 | MacMahon | 252/531 |
| 2,382,164 | 8/1945 | MacMahon | 252/531 |
| 2,382,165 | 8/1945 | MacMahon | 252/531 |
| 2,412,819 | 12/1946 | MacMahon | 252/531 |
| 3,177,147 | 4/1965 | Dugan | 252/531 |
| 4,097,418 | 6/1978 | Rolfes | 252/531 |
| 4,925,585 | 5/1990 | Strauss et al. | 252/89.1 |
| 5,045,238 | 9/1991 | Jolicoeur et al. | 252/550 |
| 5,066,425 | 11/1991 | Osofu-Asante et al. | 252/546 |
| 5,152,932 | 10/1992 | Mueller et al. | 252/550 |
| 5,178,798 | 1/1993 | Jolicoeur | 252/553 |
| 5,180,515 | 1/1993 | Boucher et al. | 252/135 |
| 5,219,495 | 6/1993 | Hsu | 252/559 |

FOREIGN PATENT DOCUMENTS

| | | |
|---|---|---|
| 0110731 | 6/1984 | European Pat. Off. . |
| 0342917 | 11/1989 | European Pat. Off. . |
| 0349201 | 1/1990 | European Pat. Off. . |
| 2412837 | 10/1974 | Germany . |
| 62-273300 | 11/1987 | Japan . |
| 557593 | 11/1943 | United Kingdom . |
| 614044 | 12/1948 | United Kingdom . |

OTHER PUBLICATIONS

"Surfactants in Consumer Products", J. Falbe (ed.), Springer Verlag, Berlin, 1986, p. 67 Chiuz 20, 1986, pp. 117–127.

*Primary Examiner*—Paul Lieberman
*Assistant Examiner*—A. Hertzog
*Attorney, Agent, or Firm*—Ernest G. Szoke; Wayne C. Jaeschke; Real J. Grandmaison

[57] ABSTRACT

Solid detergent compositions containing up to 40% by weight of water are obtained by mixing 100 parts by weight of an aqueous 40 to 60% by weight alkyl sulfate paste at 20° to 80° C. with (a) 15 to 100 parts by weight of a sodium salt selected from the group consisting of sodium sulfate, sodium carbonate and sodium silicate; and/or (b) 10 to 300 parts by weight aluminosilicate; and converting the solid mixture obtained into particulate or powder form at 20° to 60° C.

9 Claims, No Drawings

SOLID DETERGENTS

FIELD OF THE INVENTION

This invention relates to solid detergents containing anionic surfactants, sodium salts and/or aluminosilicates and to a process for their production.

PRIOR ART

Alkyl sulfates (AS), which are industrially produced by sulfation of primary alcohols, are anionic surfactants which are particularly suitable for the production of detergents and cleaning products by virtue of their excellent detergent properties and their high biodegradability.

Solid, i.e. particulate or powder-form, detergents containing alkyl sulfates, sodium sulfate and/or aluminosilicates are known, for example, from Japanese patent application JP 62/273 300.

They are normally produced from aqueous alkyl sulfate dispersions ("AS pastes") having solids contents of 40 to 60% by weight, optionally in admixture with other detergent ingredients, such as for example sodium sulfate, soda or aluminosilicates, which are converted by spray drying into a solid, anhydrous and generally powder-like form. It is of particular importance in this regard that the AS pastes are not only processed, but also stored at temperatures in the range from 60° to 80° C. because they solidify at lower temperatures and can no longer be pumped. Storage at higher temperatures is attended by the serious disadvantage that the alkyl sulfates can undergo partial hydrolysis to alcohol and sulfuric acid, so that the content of washing-active substance decreases significantly in dependence upon the storage time.

In addition, the production of powder-form detergents based on alkyl sulfates by known processes involves the almost complete removal of water which is very time- and energy-consuming. Finally, the narrow temperature range in which the AS pastes can be stored and processed is a serious disadvantage compared with the processing of most other anionic surfactant pastes.

Accordingly, the problem addressed by the present invention was to provide solid detergents based on alkyl sulfates which would be free from the disadvantages mentioned above.

DESCRIPTION OF THE INVENTION

The present invention relates to solid detergents containing anionic surfactants, sodium salts and/or aluminosilicates which are obtained by mixing 100 parts by weight of an aqueous 40 to 60% by weight alkyl sulfate paste at 20° to 80° C. with a) 15 to 100 parts by weight of a sodium salt selected from the group consisting of sodium sulfate, sodium carbonate and sodium silicate and/or b) 10 to 300 parts by weight aluminosilicate and converting the solid obtained into particulate and/or powder form at 20° to 60° C.

The present invention also relates to a process for the production of solid detergents which is characterized in that 100 parts by weight of an aqueous 40 to 60% by weight alkyl sulfate paste are mixed at 20° to 80° C. with a) 15 to 100 parts by weight of a sodium salt selected from the group consisting of sodium sulfate, sodium carbonate and sodium silicate and/or c) 10 to 300 parts by weight aluminosilicate and the solid obtained is converted into particulate and/or powder form at 20° to 60° C.

It has surprisingly been found that the gel-form, plastic alkyl sulfate pastes can be converted into solid mixtures at temperatures as low as room temperature by addition of defined quantities of the above-mentioned sodium salts and/or aluminosilicates. Despite their high water content of up to 40% by weight, the solid mixtures obtained can be mechanically size-reduced and brought into particulate or free-flowing powder form. Accordingly, the process according to the invention has a major advantage over conventional spray drying technology, particularly so far as the saving of energy is concerned.

Alkyl sulfates are known substances which may be obtained by the standard methods of preparative organic chemistry. The preferred process for their production starts out from primary alcohols of natural or synthetic origin which are first sulfated with gaseous sulfur trioxide and then neutralized with aqueous bases in known manner. Alkyl sulfate pastes having solids contents of 40 to 60% by weight, which show a gel-like consistency or are solid, can be obtained in this way [J. Falbe (ed.), "*Surfactants in Consumer Products*", *Springer Verlag, Berlin,* 1986, page 67].

Alkyl sulfate pastes in which the alkyl sulfate contains 12 to 22 carbon atoms and, more particularly, 16 to 18 carbon atoms in the alkyl radical may be used with advantage for the production of the solid detergents. Particularly preferred alkyl sulfate pastes are $C_{16/18}$ alkyl sulfate Na salt pastes based on hydrogenated tallow alcohol which have a solids content of 40 to 60% by weight and, more particularly, 50 to 55% by weight.

Aluminosilicates which may be used in the process according to the invention are compounds having varying percentage contents of $Al_2O_3$ and $SiO_2$ in which the silicon is always tetrahedrally surrounded by four oxygen atoms while aluminium is present in octahedral coordination. Particularly suitable alumosilicates are zeolites corresponding to general formula (I)

$$M_{2/z}O \cdot Al_2O_3 \cdot x\ SiO_2 \qquad (I)$$

in which M is a monovalent or polyvalent metal, z is the valency of the metal M and x is a number of 1.8 to 12. Preferred aluminosilicates are zeolites of type X, Y or L. It is particularly preferred to use zeolite A [DE-A-24 12 837]. The zeolites may be used in the form of aqueous suspensions having solids contents of at least 50% by weight or in dried form. "Dried zeolites" are understood to be aluminosilicates which, although present as dry powders, still contain 20 to 50% by weight water of crystallization. Mixtures of various zeolites may also be used in the process according to the invention. Information on the constitution of the compounds mentioned can be found in ChiuZ, 20, 118 (1986).

To produce the solid detergents according to the invention, the liquid alkyl sulfate paste is first mixed with the additives at temperatures of 20° to 80° C. 15 to 100 parts by weight and preferably 20 to 50 parts by weight of the sodium salts mentioned and/or 10 to 300 parts by weight, preferably 30 to 100 parts by weight and more preferably 50 to 75 parts by weight of the aqueous aluminosilicate are added to the aqueous alkyl sulfate paste per 100 parts by weight thereof.

In cases where particularly dry powders are to be obtained, it has proved to be of advantage to mix the alkyl sulfate paste with sodium sulfate and aluminosilicate. In this case, it is optimal if the total quantity of additives does not exceed 100 parts by weight, based on the alkyl sulfate paste. The ratio of sodium sulfate and aluminosilicate can be freely selected within the limits mentioned.

The resulting solid can be mechanically size-reduced, i.e. converted into particulate and/or powder form, at temperatures of 20° to 60° C. Breakers, mills, pelleting machines or extruders are particularly suitable for this purpose. In one particular embodiment of the invention, the additives are first dispersed in the liquid alkyl sulfate paste at 60° to 80° C. and the resulting dispersion is subsequently transferred to a cooled extruder in which it cools to temperatures of 20° to 60° C. The solidified mixture may then be size-reduced without difficulty.

The following Examples are intended to illustrate the invention without limiting it in any way.

EXAMPLES

Example 1

100 g of an aqueous 57% by weight $C_{16/18}$ alkyl sulfate sodium salt paste ($C_{16}$:$C_{18}$ ratio=1:1) were mixed with 50 g sodium sulfate at 80° C. The mixture was then size-reduced in a screw extruder with a perforated adapter disk. Despite the high water content, solid dry granules were obtained.

| Composition of the product: | |
|---|---|
| Alkyl sulfate Na salt | 38% by weight |
| Sodium sulfate | 33% by weight |
| Water | 29% by weight |

Example 2

75 g zeolite A (Wessalith ® P, a product of Degussa AG, water content approx. 20% by weight) were stirred at 80° C. into 100 g of the aqueous alkyl sulfate paste of Example 1. The liquid mixture was transferred to a water-cooled extruder in which it was cooled until solid and at the same time converted into particulate form. Despite the high water content, solid dry granules were obtained.

| Composition the product: | |
|---|---|
| Alkyl sulfate Na salt | 33% by weight |
| Zeolite A | 32% by weight |
| Water | 35% by weight |

Example 3

50 g zeolite A (Sasil ®, a product of Henkel KGaA, water content approx. 50% by weight) and 75 g sodium sulfate were stirred at 80° C. into 100 g of the aqueous alkyl sulfate paste of Example 1. The mixture was cooled to 20° C., solidifying in the process, and was then size-reduced in a powder mill. Despite the high water content, a dust-dry, non-tacky free-flowing powder was obtained.

| Composition of the product: | |
|---|---|
| Alkyl sulfate Na salt | 25% by weight |
| Zeolite A | 11% by weight |
| Sodium sulfate | 33% by weight |
| Water | 31% by weight |

We claim:

1. The process of preparing a solid, free-flowing detergent composition containing from 29 to 40% by weight of water, consisting essentially of mixing 100 parts by weight of an aqueous 40 to 60% by weight alkyl sulfate paste at 20° to 80° C. with a) 15 to 100 parts by weight of a sodium salt selected from the group consisting of sodium sulfate, sodium carbonate and sodium silicate, and/or b) 10 to 300 parts by weight aluminosilicate, wherein said components a) and/or b) are dispersed into said alkyl sulfate paste at a temperature of 60° to 80° C., the liquid mixture obtained is transferred to a water-cooled extruder, cooled therein until solid, and size-reduced into particulate or powder form.

2. A process as in claim 1 wherein said alkyl sulfate paste comprises a $C_{16}$–$C_{18}$ tallow alkyl sulfate, sodium salt paste.

3. A process as in claim 1 wherein said aluminosilicate comprises water-containing zeolite A.

4. A process as in claim 1 wherein said step of size-reducing the solid mixture into particulate or powder form is performed by mechanically size-reducing said solid mixture.

5. A process as in claim 4 wherein said step of mechanically size-reducing said solid mixture is performed with a breaker, mill, pelleting machine or extruder.

6. A solid detergent composition containing from 29 to 40% by weight of water, said composition having been prepared by mixing 100 parts by weight of an aqueous 40 to 60% by weight alkyl sulfate paste at 20° to 80° C. with a) 15 to 100 parts by weight of a sodium salt selected from the group consisting of sodium sulfate, sodium carbonate and sodium silicate, and/or b) 10 to 300 parts by weight aluminosilicate, wherein said components a) and/or b) are dispersed into said alkyl sulfate paste at a temperature of 60° to 80° C., the liquid mixture obtained is transferred to a water-cooled extruder, cooled therein until solid, and size-reduced into particulate or powder form.

7. A solid detergent composition as in claim 6 wherein said alkyl sulfate paste comprises a $C_{16}$–$C_{18}$ tallow alkyl sulfate, sodium salt paste.

8. A solid detergent composition as in claim 6 wherein said aluminosilicate comprises water-containing zeolite A.

9. A solid detergent composition as in claim 6 wherein the solid mixture has been size reduced into particulate or powder form by mechanically size-reducing said solid mixture.

* * * * *